US005323300A

United States Patent [19]

McCrary

[11] Patent Number: 5,323,300

[45] Date of Patent: * Jun. 21, 1994

[54] JEWELRY LIGHTING DEVICE

[76] Inventor: Charles F. McCrary, 1005 Wheeler Dr., Hanahan, S.C. 29406

[ * ] Notice: The portion of the term of this patent subsequent to May 26, 2009 has been disclaimed.

[21] Appl. No.: 908,035

[22] Filed: Jul. 6, 1992

[51] Int. Cl.[5] ..... F21L 15/08

[52] U.S. Cl. ..... 362/104; 362/32; 362/34; 362/84; 362/806; 63/2; 63/15; 63/26

[58] Field of Search ..... 362/26, 27, 30, 32, 362/34, 84, 103, 104, 806; 63/2, 15, 26, 12, 13, 14.1

[56] References Cited

U.S. PATENT DOCUMENTS

| | | | |
|---|---|---|---|
| 1,771,710 | 7/1930 | Gover | 63/2 L |
| 3,521,049 | 7/1970 | Young | 63/2 L |
| 3,790,775 | 2/1974 | Rosenblatt | 362/104 |
| 4,061,910 | 12/1977 | Rosenfeld | 362/104 |
| 4,093,973 | 6/1978 | Vaagenes | 362/104 |
| 4,186,425 | 1/1980 | Nadimi | 362/104 |
| 4,942,744 | 7/1990 | Wei | 63/15 |
| 4,998,186 | 3/1991 | Cocca | 362/104 |
| 5,117,338 | 5/1992 | McCrary | 362/104 |

*Primary Examiner*—Ira S. Lazarus
*Assistant Examiner*—Alan B. Cariaso
*Attorney, Agent, or Firm*—B. Craig Killough

[57] ABSTRACT

A lighting device mounted within a jewelry setting which is directed at a facet of a gemstone to increase the brilliance and brightness of the gemstone. The lighting means is a low dispersion, focused beam of light which is directed at a facet of a gemstone so that the gemstone captures the light. In the preferred embodiment, the lighting source is radioluminescent or electroluminescent and uses various focusing means to focus the light from the lighting means. Fiber optic material may be used to direct light at the gemstone. The fiber optic material may contain dyes which absorb ambient light and cause the light to be directed in desired wave lengths at the gemstone. The fiber optic material may absorb light from the lighting means, as well as ambient light, to provide additional illumination in relatively high ambient light situations.

13 Claims, 2 Drawing Sheets

JEWELRY LIGHTING DEVICE

BACKGROUND OF THE INVENTION

The present invention pertains to jewelry in general, and is specifically directed to lighting means mounted in a jewelry setting which is used to light a gemstone mounted within the setting, to increase the brightness and brilliance of the gemstone.

Gemstones are commonly mounted to jewelry settings. Precious and semi-precious stones are mounted within settings of various materials, which are usually precious and semi-precious metals. Common examples of such jewelry are rings, bracelets, necklaces, pendants, and earrings. Brightness and brilliance are desirable characteristics and qualities which are associated with gemstones. It is highly desirable for gemstones to reflect and refract light to increase their beauty. Often, the value of a gemstone is associated with its ability to reflect and refract light clearly. Gemstones do not generate light, and the light must be provided from an external source.

The brightness and brilliance of a gemstone is affected by the cut and quality of the stone, the type of stone, as well as the available light in the environment in which the stone is worn. Unless a lighting means is provided for and directed toward the gemstone, the gemstone will reflect and refract only the light which is in the room or other environment. The brilliance and brightness of the stone will be increased if the light is directed from the setting, rather than the environment.

SUMMARY OF THE PRESENT INVENTION

The present invention provides a lighting means which is mounted in a jewelry setting in which a gemstone is mounted, with the lighting device mounted externally to the gemstone. The lighting device emits a beam of light, which is well focused at a selected facet of the gemstone, so as to strike the facet of the gemstone with very low dispersion. It is necessary for the lighting means to be relatively small, and accordingly, the amount of light which is emitted from the lighting means will be relatively low. However, a well focused beam of light, even of low power, directed at a facet of a stone from the jewelry setting of the stone will result in and yield great brilliance and brightness to the stone, particularly indoors where the ambient light is lower. Through the use of radioluminescent and electroluminescent lighting means, including electroluminescent means powered by a thermocouple deriving energy from the wearer's body heat, a satisfactory lighting of the gemstone will result. Other lighting means, such as incandescent light or light emitting diodes could be used.

The light may be directed by fiber optic material. The fiber optic material may absorb light from the lighting means, or it could absorb ambient light. The jewelry may be designed so as to direct light from the lighting means or ambient light at the fiber optic material, which then absorbs and directs the light at the gem stone. Dyes may used within the fiber optic material to cause the desired wave length to be directed at the gem stone, depending upon the color of the gem stone.

DETAILED DESCRIPTION OF THE DRAWINGS

FIG. 1 is a perspective view of a ring 2 with a gemstone 4 mounted on the ring, with the lighting device 6 mounted within the ring setting.

DETAILED DESCRIPTION OF THE PREFERRED EMBODIMENT

Figure 1:
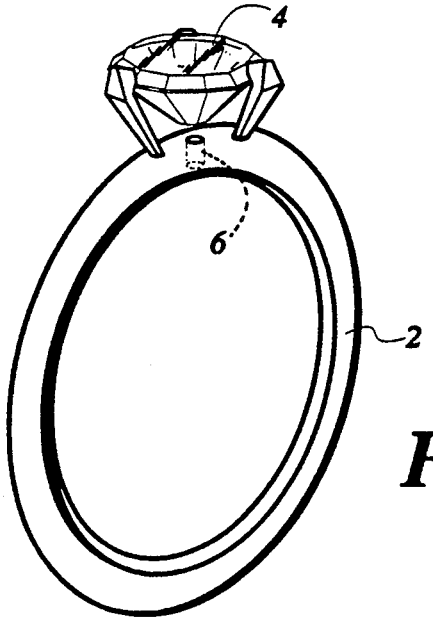
Figure 2:
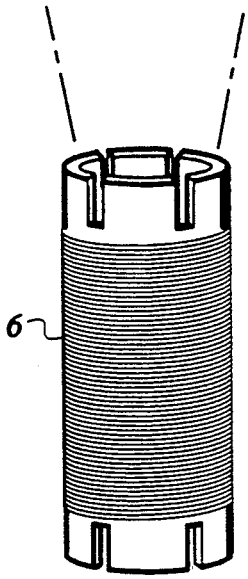
FIG. 2 is a perspective view of a lighting device.

The lighting means of the present invention may be mounted to a jewelry setting having a gemstone. As shown in FIG. 1, the jewelry setting may be a ring 2, and the gemstone may be a diamond 4.

The lighting means 6 is mounted to the jewelry setting externally to the gemstone. The lighting means 6 as shown in FIG. 1 is mounted within a void formed within the ring. The lighting means may be mounted by threaded means, by soldering, by adhesive means or other means.

The jewelry lighting device 6 is mounted externally to the gemstone 4, so that a beam of light is directed from the lighting means toward a facet of the gemstone. The beam of light is focused so as to reduce dispersion of the beam of light to an absolute minimum. The beam of light should strike a facet of the gemstone at a right angle, or no more than 45° from a right angle.

The jewelry setting could be any jewelry setting in which a gemstone is mounted. The jewelry setting could be a ring, a bracelet, a necklace, earrings, or other jewelry setting. The gemstone could be any precious or semi-precious gemstone. As used herein, gemstone means any material which could be placed within a jewelry setting and which is transparent or translucent.

In general, it is desirable that the lighting means emit as white a light as possible. If the lighting means is used to light a diamond, a white light is particularly desirable. In other applications, lighting means comprising other colors may be acceptable.

It is desired that the lighting means emit a beam of light which is as focused as possible, and that dispersion is kept to an absolute minimum, so that substantially all of the light strikes the facet of the gemstone at which the light is directed. The device should be placed externally to the gemstone, but close enough to the gemstone that 90% of the light, measured in candle power, will strike the plane of the facet of the gemstone at which the light is directed. The factors which will achieve this goal are the use of a low dispersion lighting means, placing the lighting means relatively closely to the gemstone, and focusing the beam of light on the facet.

Figure 3:
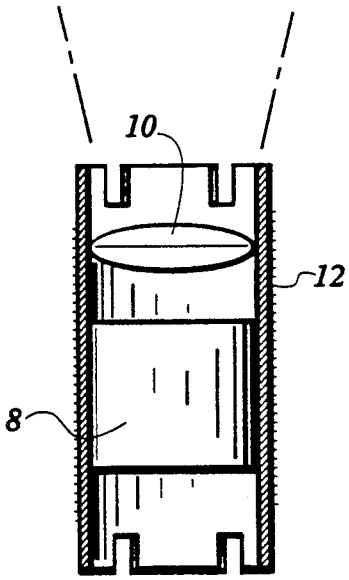
FIG. 3 is a side elevation of a jewelry lighting device, sectioned to reveal the light emitting means 8 and a lens 10.

To achieve a well focused light, a lens 10 may be placed within the lighting means. FIG. 3. The particular lens and the location of the lens relative to the light source will allow a focusing of the light on the facet.

A low dispersion lighting means may be achieved by capturing light in a tube 12. The light source 8 is placed, as is shown in FIG. 3, so that as light exits the lighting means it must pass through the tube 12. As the distance from the light source to the tube is increased, the dispersion of the light as it exits the tube is decreased.

Since the overall device as contemplated herein is relatively small, the tube will be short. Additional focusing may be accomplished by the use of as lens 10 with a convergent focus. By the use of the lens, the light may be focused so as to converge on the selected facet of the gemstone. The particular convergent lens to be used will depend on the location of the lens relative to the light source, and will be determined by the distance of the light from the facet, and the length of the tube.

Figure 4:
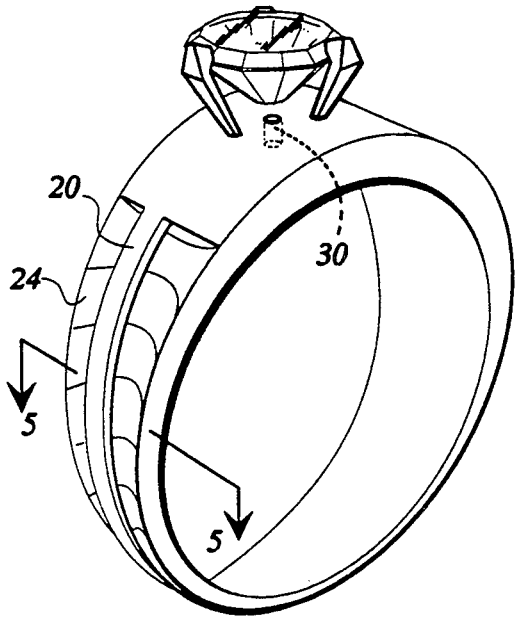
FIG. 4 is a perspective view of a ring incorporating fiber optic material to collect light and direct light at a gemstone.
Figure 5:
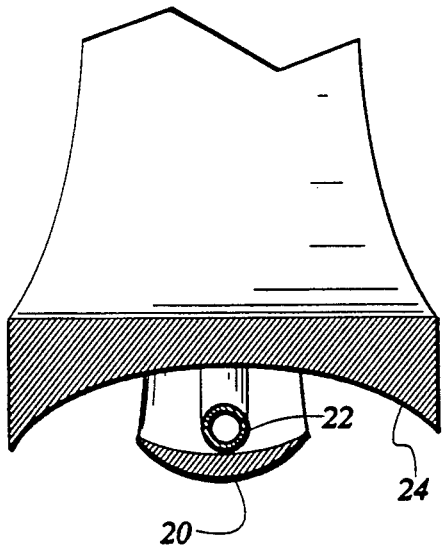
FIG. 5 is a sectional view taken essentially along line 5—S of FIG. 4.

Fiber optic material may be used to capture light emitted by the light source, and to direct the light at the desired facet in a focused manner. Fiber optic material 22 may be placed so as to collect light from the light source, with the exit point of the light for the tube positioned so as to direct a beam of light at the desired facet. A tube 30 maybe used to decrease dispersion of the light as it exits the fiber optic material. As shown in FIGS. 4 and 5, fiber optic material 22 may be placed around part or all of the circumference of the ring. By being exposed to ambient light in this fashion, the fiber optic material will collect ambient light and direct it at the gemstone. Additionally, the fiber optic material may absorb light from an artificial light source or sources such as light source 8.

The ring may incorporate a cover 20 which is placed over the fiber optic strand 22 for aesthetic purposes. The surface 24 of the exterior of the ring, which will typically be a reflective metal, may be curved to cause maximum light to be reflected toward the fiber optic material.

The fiber optic material may contain dyes which absorb light. The light may be ambient light, or it may be light from an artificial light source, such as light source 8. The dyes not only absorb the light, they cause the fiber optic material to emit and direct light in wave lengths determined by the specific dye which is used.

Where there is a relatively high level of ambient light, a greater amount of light must be used to illuminate the gemstone to achieve the desired effect. Accordingly, the use of the light absorbing dye in absorbing ambient light yields greater illumination than the use of a radioluminescent, electroluminescent, incandescent or other artificial light source alone. The combination of the absorption of ambient light by the dyes and the artificial light source provide the desired illumination where relatively high levels of ambient light are present. Where the ambient light is lower, a lower level of illumination is sufficient to increase the brilliance of the gemstone through the use of the device. Accordingly, in this situation, the light source alone will provide the desired illumination without the presence of ambient light.

The light source 8 may be radioluminescent. "Radioluminescent", as used herein, means the production of visible light from the excitement of a material such as phosphorous, which is caused by energy imparted to the phosphorous and derived from the close proximity of the phosphorous to a radioactive material such as tritium. As the energy is supplied form the radioactive decay of the material such as tritium, the excited phosphorous emits light.

The light source may be electroluminescent. The electroluminescent light source may be powered by a battery, or by a thermocouple. A thermocouple may be used to generate a current to power the light source, with the body heat of the wearer used to provide heat energy to the thermocouple from which a current is generated to power the light source.

Other lighting sources could be used. The lighting source could be incandescent or light emitting diodes (LEDs).

The light source could be any light source which will produce light from the current generated by the thermocouple. However, in the preferred embodiment, a phosphorous light source is used to produce a white light.

What is claimed is:

1. A gemstone lighting device for gemstones placed within a jewelry setting, comprising:

a. a stone which is mounted in a jewelry setting; and b. a lighting means which is mounted to said jewelry setting externally to said gemstone, wherein said lighting means emits a focused beam of light from said lighting means so that said focused beam of light strikes a facet of said gemstone at an angle of 45° to 90° to a plane of said facet.

2. A gemstone lighting device for gemstones placed within a jewelry setting as described in claim 1, wherein said lighting means is radioluminescent.

3. A gemstone lighting device for gemstones placed within a jewelry setting as described in claim 1, wherein said lighting means is electroluminescent.

4. A gemstone lighting device for gemstones placed within a jewelry setting as described in claim 1, wherein said lighting means is incandescent.

5. A gemstone lighting device for gemstones place within a jewelry setting as described in claim 1, wherein said lighting means is a light emitting diode.

6. A gemstone lighting device for gemstones placed within a jewelry setting as described in claim 2, wherein said lighting means further comprises a focusing means to focus said beam of light to reduce dispersion of said beam of light so that not less than 90% of said light measured in candle power strikes said facet of said gemstone.

7. A gemstone lighting device for gemstones placed within a jewelry setting as described in claim 3, wherein said lighting means further comprises a focusing means to focus said beam of light to reduce dispersion of said beam of light so that not less than 90% of said light measured in candle power strikes said facet of said gemstone.

8. A gemstone lighting device for gemstones placed within a jewelry setting as described in claim 4, wherein said lighting means further comprises a focusing means to focus said beam of light to reduce dispersion of said beam of light so that not less than 90% of said light measured in candle power strikes said facet of said gemstone.

9. A gemstone lighting device for gemstones placed within a jewelry setting as described in claim 3, wherein said electroluminescent means is powered by a current generated by a thermocouple using body heat from a wearer of said jewelry setting to generate said current.

10. A gemstone lighting device for gemstones placed within a jewelry setting as described in claim 4, wherein said incandescent means is powered by a current generated by a thermocouple using body heat from a wearer of said jewelry setting to generate said current.

11. A gemstone lighting device for gemstones placed within a jewelry setting as described in claim 5, wherein said light emitting diode is powered by a current generated by a thermocouple using body heat from a wearer of said jewelry setting to generate said current.

12. A gemstone lighting device for gemstones placed within a jewelry setting, comprising:

a. a jewelry setting;

b. a stone which is mounted within said jewelry setting;

c. a lighting means which is mounted to said jewelry setting and externally to said stone;

d. a fiber optic material which is mounted to said jewelry setting and externally to said stone, having dye therein which absorbs light and which directs a beam of light of a wavelength determined by said dye at said stone; and e. a tube, wherein said beam of light which is directed from said fiber optic material at said stone passes through said tube and out of an open end of said tube so as to decrease dispersion of said light.

13. A gemstone lighting device for gemstones placed within a jewelry setting as described in claim 12, wherein said tube has a convergent lens present therein and through which said beam of light passes so as to be focused on a facet of said stone.

* * * * *